US006539550B1

(12) United States Patent
Flores

(10) Patent No.: US 6,539,550 B1
(45) Date of Patent: Apr. 1, 2003

(54) SET OF DRIVING GLOVES

(76) Inventor: Barbara Flores, 31339 Seminole St., Temecula, CA (US) 92591

( * ) Notice: Subject to any disclaimer, the term of this patent is extended or adjusted under 35 U.S.C. 154(b) by 0 days.

(21) Appl. No.: 10/122,951

(22) Filed: Apr. 12, 2002

(51) Int. Cl.[7] ..... A41D 13/08
(52) U.S. Cl. ..... 2/16; 2/159
(58) Field of Search ..... 2/16, 159, 161.6, 2/162, 163, 166, 167, 910, 917

(56) References Cited

U.S. PATENT DOCUMENTS 4,785,478 A * 11/1988 Mosley ..... 2/161.6
5,357,633 A * 10/1994 Rael ..... 2/16
5,628,062 A * 5/1997 Tseng ..... 2/16
6,029,278 A * 2/2000 Lopez ..... 2/209.13

* cited by examiner

*Primary Examiner*—Gary L. Welch
(74) *Attorney, Agent, or Firm*—Goldstein & Lavas, P.C.

(57) ABSTRACT

A set of three driving gloves, each having a different length to be worn by a driver. Each glove has a varying length with finger portions cut away to allow for greater flexibility when driving. The set includes a full length glove, a medium length glove, and a short glove.

3 Claims, 2 Drawing Sheets

SET OF DRIVING GLOVES

BACKGROUND OF THE INVENTION

The invention relates to a set of driving gloves. In particular, the invention is a set of driving gloves available in three different lengths for use while driving. The gloves are constructed from a light weight, breathable material to protect the driver's exposed arm from sun rays.

When driving an automobile or truck, it is common for the driver to rest his or her left arm outside the vehicle's window. This positioning of the arm leaves the skin exposed to the sun and its harmful ultraviolet rays.

Thus, there exists a need for a driving glove that covers parts of the arm that may be exposed to the sun. Such a glove should be available in a variety of lengths, therefore enabling a driver to choose the appropriate length according to the type of shirt he or she is wearing. Further, the glove should be constructed from a breathable, lightweight material for added comfort while driving.

While these units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved set of driving gloves. As such, the general purpose of the present invention, which will be described subsequently in greater detail, is to provide a new and improved set of driving gloves which has all the advantages of the prior art and none of the disadvantages.

To attain this, the present invention essentially comprises a set of three driving gloves, each having a different length to be worn by a driver. Each glove has a varying length with finger portions cut away to allow for greater flexibility when driving. The set includes a full length glove, a medium length glove, and a short glove.

It is an object of the invention to produce a set of driving gloves that covers portions of the arm above the wrist area. Accordingly, the set includes gloves of different lengths to accommodate the amount of skin exposed on the driver's arm.

It is a further object of the invention to produce a set of driving gloves that protects the driver's arm from exposure to harmful ultraviolet rays. Accordingly, each glove is constructed from a breathable material that does not allow penetration of the sun's rays.

It is a further object of the invention to produce a set of driving gloves that may be chosen to match the clothing of the driver. Accordingly, the gloves are available in a variety of colors, including skin tones.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
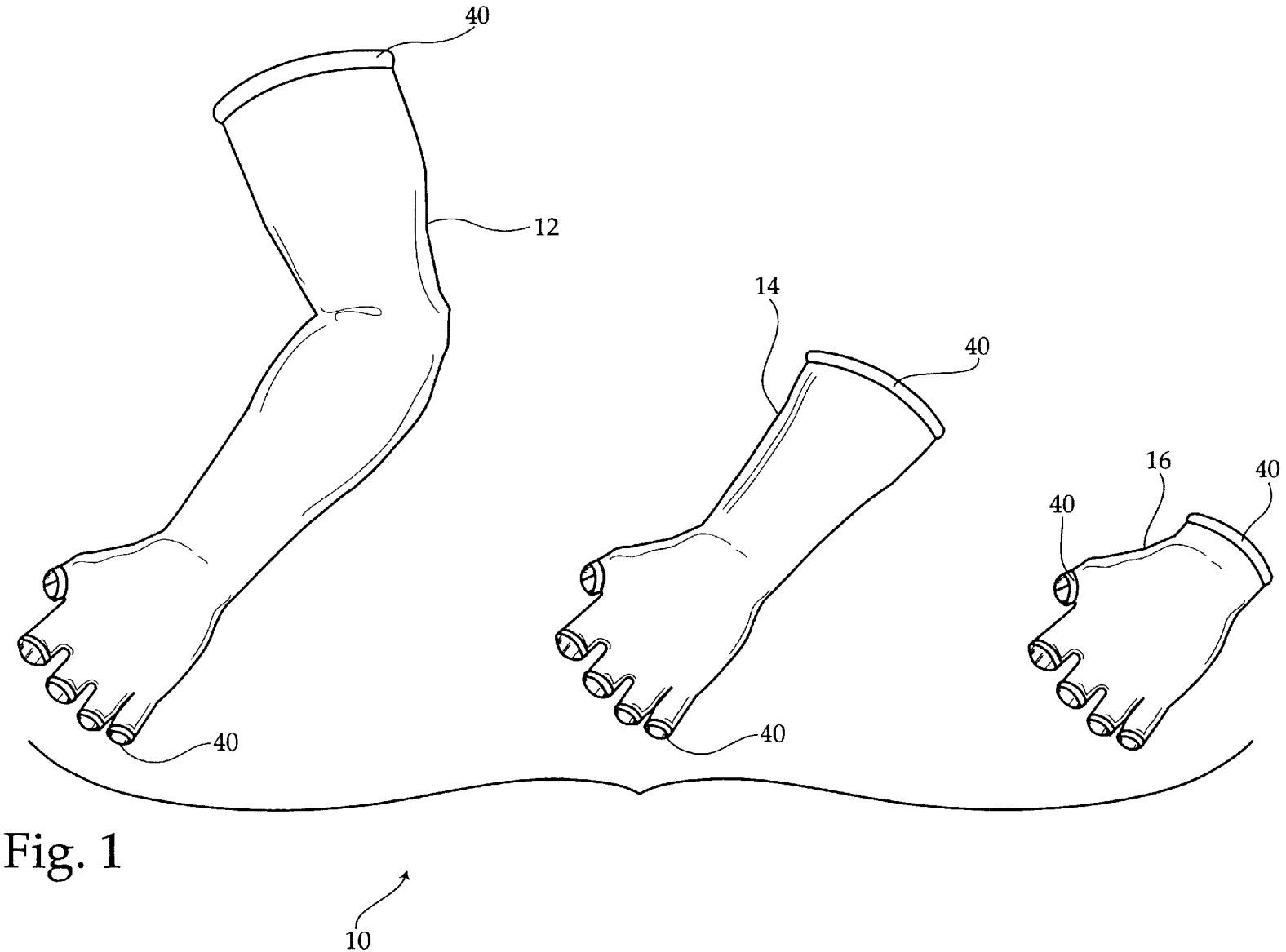
FIG. 1 is a perspective view of the set of driving gloves.

10 set of driving gloves
12 full length glove
14 medium length glove
16 short glove
18 upper portion of glove
20 lower portion of glove
24 driver
26 arm
28 upper arm portion
30 elbow
32 wrist
34 hand
36 finger
38 sleeve on lower portion
40 ribbing

DETAILED DESCRIPTION OF THE PREFERRED EMBODIMENTS

FIG. 1 illustrates a set 10 of three driving gloves, each having a different length to be worn by a driver 24. The glove is worn over the driver's arm 26, the arm 26 having an upper arm portion 28, an elbow 30, a wrist 32, and a hand 34 with fingers 36. Each glove has a varying length with finger portions cut away to allow for greater flexibility when driving.

The first glove in the set 10 is a full length glove 12, said glove 12 extending to the upper arm portion 28 of the driver 24. The second glove is a medium length glove 14 that extends just below the driver's elbow 30, and the third glove is a short glove 16 that is worn around the driver's wrist 32.

Each glove 12, 14, 16 has a lower portion 20 and an upper portion 18. The lower portion 20 is worn around the hand 34, while the upper portion 18 extends upward along the arm 26, depending on the length of the glove. The lower portion 20 of the glove has open sleeves 38 to accommodate the driver's fingers 36. These sleeves 38 allow the driver 24 to enjoy greater flexibility with his fingers 36 while driving. A ribbing 40 extends around each sleeve 38 and around the upper portion 20 to keep the glove in place.

The gloves 12, 14, 16 are preferably constructed from a lightweight breathable material to afford the driver 24 comfort and flexibility while wearing said gloves. Further, the material is a sun-blocking fabric, such as Dupont's SOLERNET™, which contains 95% effective sunscreen. Constrastly, regular cotton material contains only about 50% effective sunscreen.

Figure 4:
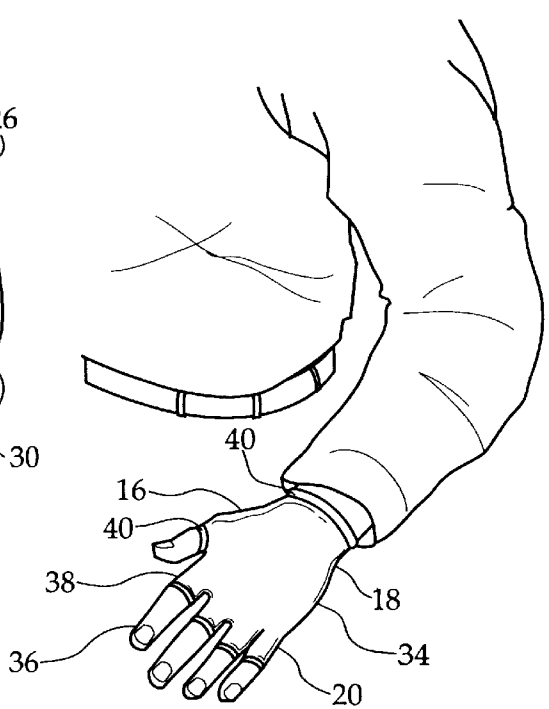
FIG. 4 is a perspective view of the short driving glove worn by a driver.
Figure 3:
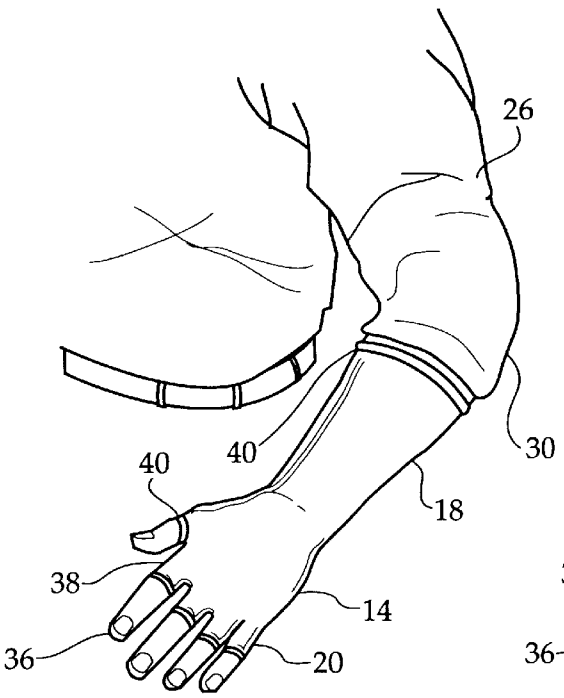
FIG. 3 is a perspective view of the medium length driving glove worn by a driver.
Figure 2:
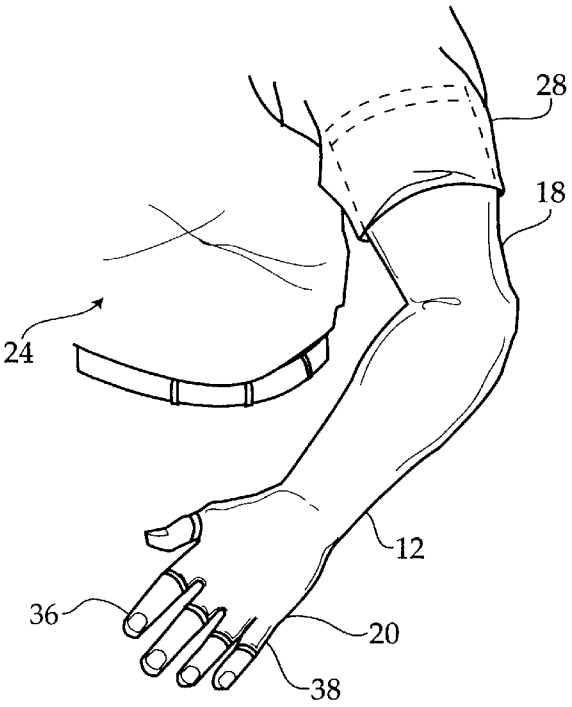
FIG. 2 is a perspective view of the full length driving glove worn by a driver.

In use, one of the gloves is chosen from the set 10 according to the type of shirt being worn by the driver 24, as illustrated in FIGS. 2–4. When wearing a short sleeve shirt, the full length glove 12 is worn to protect the whole length of the arm 26 from exposure to the sun. Similarly, the medium length glove 14 may be chosen when wearing a longer sleeved shirt, and the short glove 16 is utilized when the driver 24 has a long sleeve shirt. To wear the glove, the driver 24 places his/her hand 34 through the upper portion 18 of the glove, and pulls the glove over the arm 26. Each finger 36 is mated with one of the sleeves 38.

In conclusion, herein is presented a set of driving gloves. The invention is illustrated by example in the drawing figures, and throughout the written description. It should be understood that numerous variations are possible, while adhering to the inventive concept. Such variations are contemplated as being a part of the present invention.

What is claimed is:

1. A set of driving gloves to be worn by a driver, the driver having an upper arm portion, a lower arm portion, an elbow, a wrist, a hand, and fingers, comprising:

a full length glove, the glove having an upper portion and a lower portion, the upper portion extending around the upper arm portion and the lower portion extending around the hand, the lower portion having a plurality of sleeves to accommodate the fingers;

a medium length glove, the glove having an upper portion and a lower portion, the upper portion extending near the elbow and the lower portion extending around the hand, the lower portion having sleeves to accommodate the fingers;

a short glove, the glove having an upper portion and a lower portion, the upper portion extending around the wrist and the lower portion extending around the hand, the lower portion having sleeves to accommodate the fingers; and wherein the gloves are constructed from a sun-blocking material and are worn by the driver to protect his or her skin from exposure to the sun, the length of the glove chosen according to the dressing worn by the driver.

2. The set of driving gloves as recited in claim 1, wherein the gloves further comprise ribbing extending around the upper potion and each sleeve, said ribbing serving to keep the glove in place about the arm.

3. A method of protecting a driver's arm from sun exposure using a set of driving gloves, the driver having an arm and a hand with fingers, the set of gloves containing a full length glove, a medium length glove, and a short glove, each glove having an upper portion, a lower portion, and a plurality of sleeves at the lower portion, comprising the steps of:

selecting one of the gloves from the set by choosing the appropriate sized glove according to the type of dressing worn by the driver;

placing the driver's hand through the upper portion of the selected glove;

extending the hand through the length of the glove, towards the lower portion; and extending the fingers through the sleeves.

* * * * *